US009613742B2

(12) United States Patent
Kanami

(10) Patent No.: US 9,613,742 B2
(45) Date of Patent: Apr. 4, 2017

(54) ELECTRONIC COMPONENT

(71) Applicant: MURATA MANUFACTURING CO., LTD., Kyoto-fu (JP)

(72) Inventor: Wataru Kanami, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 14/799,199

(22) Filed: Jul. 14, 2015

(65) Prior Publication Data

US 2015/0357114 A1 Dec. 10, 2015

Related U.S. Application Data

(63) Continuation of application No. PCT/JP2014/051460, filed on Jan. 24, 2014.

(30) Foreign Application Priority Data

Feb. 13, 2013 (JP) ..... 2013-025635

(51) Int. Cl.

| | |
|---|---|
| ***H01F 5/00*** | (2006.01) |
| ***H01F 27/28*** | (2006.01) |
| ***H01F 27/245*** | (2006.01) |
| ***H01F 1/22*** | (2006.01) |
| ***H01F 17/04*** | (2006.01) |
| ***H01F 1/34*** | (2006.01) |
| *H01F 27/29* | (2006.01) |

(52) U.S. Cl.

CPC ..... *H01F 27/2804* (2013.01); *H01F 1/22* (2013.01); *H01F 1/344* (2013.01); *H01F 17/04* (2013.01); *H01F 27/245* (2013.01); *H01F 27/292* (2013.01)

(58) Field of Classification Search

CPC ..... H01F 1/22

See application file for complete search history.

(56) References Cited

U.S. PATENT DOCUMENTS 6,310,534 B1 10/2001 Brunner
2006/0119460 A1* 6/2006 Farmer ..... H01B 7/0063 336/174

(Continued)

FOREIGN PATENT DOCUMENTS

JP H07-022266 A 1/1995
JP H08-130144 A 5/1996

(Continued)

OTHER PUBLICATIONS

Written Opinion of the International Searching Authority, PCT/JP2014/051460, Mar. 27, 2014.

*Primary Examiner* — Elvin G Enad
*Assistant Examiner* — Ronald Hinson
(74) *Attorney, Agent, or Firm* — Studebaker & Brackett PC

(57) ABSTRACT

To restrict a phenomenon that the direct-current resistance value after firing is larger than the direct-current resistance value before firing in an electronic component in which a conductor formed of a wire rod is embedded in a ceramic sintered compact. An electronic component 10 includes a ceramic sintered compact 12 and an inner conductor 30. The inner conductor 30 configures a circuit element, and is formed of a wire rod having nickel added thereto and containing copper as a major constituent.

6 Claims, 9 Drawing Sheets

(56) References Cited

U.S. PATENT DOCUMENTS

| | | | | |
|---|---|---|---|---|
| 2010/0085139 | A1* | 4/2010 | Yan | H01F 1/15358<br>336/221 |
| 2010/0321140 | A1 | 12/2010 | Tanaka et al. | |
| 2012/0326828 | A1* | 12/2012 | Nakamura | H01F 1/344<br>336/200 |

FOREIGN PATENT DOCUMENTS

| | | | |
|---|---|---|---|
| JP | H10-097939 | A | 4/1998 |
| JP | 2001-267118 | A | 9/2001 |
| JP | 2003-059725 | A | 2/2003 |
| JP | 2008-263213 | A | 10/2008 |
| WO | 2008/096795 | A1 | 8/2008 |

* cited by examiner

ELECTRONIC COMPONENT

CROSS-REFERENCE TO RELATED APPLICATION

This application claims benefit of priority to Japanese Patent Application No. 2013-025635 filed Feb. 13, 2013, and to International Patent Application PCT/JP2014/051460 filed Jan. 24, 2014, the entire content of each of which is incorporated herein by reference.

TECHNICAL FIELD

The present disclosure relates to electronic components. In particular, the present disclosure relates to an electronic component in which a conductor formed of a wire rod is embedded in a ceramic sintered compact.

BACKGROUND

As a conventional electronic component in which a conductor formed of a wire rod is embedded in a ceramic sintered compact, there is known an inductor element described in Japanese Unexamined Patent Application Publication No. 7-22266. As shown in FIG. 8, an inductor element 500 of this type is a sintered compact in which a plurality of ferrite sheets 501 are stacked. A metal conductor 503 is arranged in the sintered compact. The metal conductor 503 is a rod-shaped member made of silver or copper. Also, a terminal electrode (not shown) is formed on a surface of the inductor element 500.

Meanwhile, as shown in FIG. 9, in the inductor element 500, a crack may be generated because the grain boundary is coarsened when crystal grains are grown during firing, in the metal conductor 503 which was linear before firing. Then, if a compression force by contraction of the ferrite sheets during firing is applied to the metal conductor 503 with the crack generated, as shown in FIG. 10, the metal conductor 503 may be broken at a plurality of positions. Accordingly, there has been a problem in which the direct-current resistance value of the inductor element 500 after firing is larger than the direct-current resistance value of the inductor element 500 before firing.

SUMMARY

Technical Problem

Therefore, an object of the present disclosure is to restrict a phenomenon that the direct-current resistance value after firing is larger than the direct-current resistance value before firing in an electronic component in which a conductor formed of a wire rod is embedded in a ceramic sintered compact.

Solution to Problem

An electronic component according to a first aspect of the disclosure includes:

a ceramic sintered compact; and an inner conductor formed of a wire rod containing copper as a major constituent and having nickel added thereto, the inner conductor configuring a circuit element.

An electronic component according to a second aspect of the disclosure includes:

a ceramic sintered compact; and an inner conductor configuring a circuit element and formed of a wire rod containing copper as a major constituent, in which a surface of the wire rod is coated with nickel.

Advantageous Effects of Disclosure

With the electronic component according to the present disclosure, the phenomenon that the direct-current resistance value after firing is larger than the direct-current resistance value before firing can be restricted by restricting the growth of crystal grains during firing.

FIRST EMBODIMENT

Figure 1:
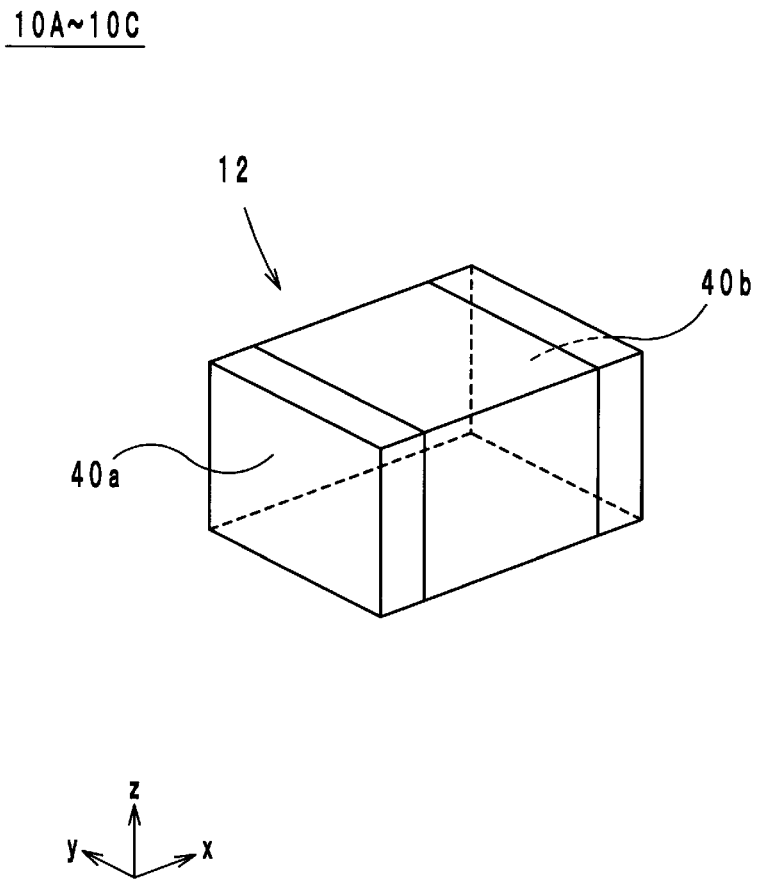
FIG. 1 is an external perspective view of an electronic component of a first embodiment.
Figure 2:
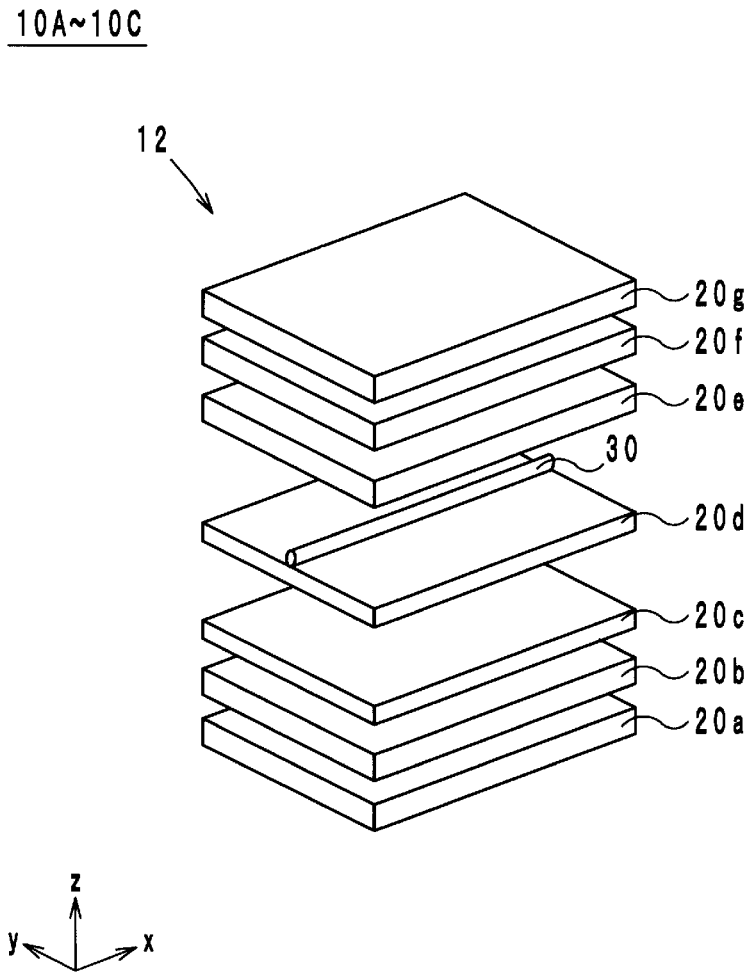
FIG. 2 is an exploded perspective view of a multilayer body in the electronic component of the first embodiment.

An electronic component 10A of a first embodiment is described below with reference to the drawings. FIG. 1 is an external perspective view of the electronic component 10A of the first embodiment. FIG. 2 is an exploded perspective view of a multilayer body 12 of the electronic component 10A of the first embodiment. Hereinafter, a stacking direction of the electronic component 10A is defined as a z-axis direction, and a direction along a long side of the electronic component 10A in plan view in the z-axis direction is defined as an x-axis direction. Further, a direction along a short side of the electronic component 10A in plan view in the z-axis direction is defined as a y-axis direction. The x-, y-, and z-axes are orthogonal to one another.

As shown in FIG. 1, the electronic component 10A has a rectangular-parallelepiped-like shape. Also, the electronic component 10A is configured of a multilayer body (ceramic sintered compact) 12, an inner conductor 30, and outer electrodes 40*a* and 40*b*.

As shown in FIG. 2, the multilayer body 12 is configured by stacking insulating layers 20*a* to 20*g* in that order from the negative direction side toward the positive direction side in the z-axis direction. Also, the respective insulating layers 20*a* to 20*g* each have a rectangular shape in plan view in the z-axis direction. Hence, the multilayer body 12 configured by stacking the insulating layers 20*a* to 20*g* is a rectangular parallelepiped as shown in FIG. 1. The material of the insulating layers is ferrite containing Fe, Ni, Zn, Cu, and Mn. Hereinafter, a surface at the positive direction side in the z-axis direction of each of the insulating layers 20*a* to 20*g* is called upper surface.

As shown in FIG. 2, the inner conductor 30 is arranged on the upper surface of the insulating layer 20*d* at the center in the y-axis direction, and is embedded in the multilayer body 12. Also, the inner conductor 30 is a linear conductor parallel to the x-axis direction and has a circular cross-sectional shape. That is, the inner conductor 30 is a wire rod fabricated by extending a metal member. The material of the inner conductor 30 is a copper alloy in which nickel is added to copper being a major constituent. When copper in the inner conductor 30 is 100 parts by weight, the addition amount of nickel is 1 part by weight. A copper alloy in which nickel is added to copper has a higher melting point than the melting point of copper. Both ends of the inner conductor 30 are exposed from surfaces at both the positive and negative sides in the x-axis direction of the multilayer body 12, and are connected to the outer electrodes 40*a* and 40*b* (described later).

As shown in FIG. 1, the outer electrode 40*a* is provided to cover the surface at the negative direction side in the x-axis direction of the multilayer body 12. Also, the outer electrode 40*b* is provided to cover the surface at the positive direction side in the x-axis direction of the multilayer body 12. The material of the outer electrodes 40*a* and 40*b* is a conductive material, such as Au, Ag, Pd, Cu, or Ni. Also, as described above, the outer electrodes 40*a* and 40*b* are connected to both ends of the inner conductor 30.

Manufacturing Method of Electronic Component

A manufacturing method of the electronic component 10A configured as described above is described below. While a single electronic component 10A is described below, a plurality of electronic components 10A are actually obtained by fabricating a mother multilayer body in which a plurality of unfired sintered compacts 12 are connected, cutting the mother multilayer body, and then forming the outer electrodes 40*a* and 40*b*.

First, ceramic green sheets which become the insulating layers 20*a* to 20*g* are prepared. To be specific, 49 mol % of a mixture of ferric oxide ($Fe_2O_3$) and manganese oxide ($Mn_2O_3$), 25 mol % of zinc oxide (ZnO), 21 to 26 mol % of nickel oxide (NiO), and 0 to 5 mol % of copper oxide (CuO) are weighted by the ratio, these materials are charged as raw materials into a pot mill, and wet blending is executed. The obtained mixture is dried and crushed, the obtained power is calcinated at 700° C. to 800° C. for a predetermined period of time, and thus ferrite ceramic powder is obtained.

An organic solvent, such as an organic binder based on polyvinyl butyral, ethanol, or toluene, is added to this ferrite ceramic powder, the materials are mixed in a pot mill, then deareation is executed by decompression, and thus ceramic slurry is obtained. The obtained ceramic slurry is formed in a sheet-like shape on a carrier sheet by a doctor blade method and dried. Thus, a ceramic green sheet to be each of the insulating layers 20*a* to 20*g* is fabricated.

Next, the inner conductor 30 being the wire rod containing copper as the major constituent is arranged on a surface of the ceramic green sheet to be the insulating layer 20*d*.

Next, the ceramic green sheets to be the insulating layers 20*a* to 20*g* are stacked and pressure-bonded in that order, and an unfired mother multilayer body is obtained. Then, final pressure bonding is executed by pressing the unfired mother multilayer body by isostatic press.

Next, the mother multilayer body is cut into multilayer bodies 12 each having a predetermined dimension by a cutting edge. Then, binder eliminating processing and firing are executed on each unfired multilayer body 12. The binder eliminating processing applies heat under an atmosphere in which copper in the inner conductor 30 is not oxidized. For example, the processing is executed under conditions at 500° C. for 2 hours in a low-oxygen atmosphere. Also, firing is executed in a firing furnace whose atmosphere is adjusted with mixed gas of $N_2$—$H_2$—$H_2O$ so as to attain a parallel oxygen partial pressure or lower of Cu—$Cu_2O$, under conditions at 900° C. to 1050° C. for a predetermined period of time.

Next, the outer electrodes 40*a* and 40*b* are formed. First, an electrode paste made of a conductive material containing Cu as a major constituent is applied to side surfaces of the sintered compact 12. Then, the applied electrode paste is baked at about 900° C. Accordingly, base electrodes of the outer electrode 40*a* and 40*b* are formed.

Finally, the surfaces of the base electrodes are treated with nickel plating and tin plating. Accordingly, the outer electrode 40*a* and 40*b* are formed. With the above-described processes, the electronic component 10A is completed.

Advantageous Effects

With the electronic component 10A, the phenomenon that the direct-current resistance value after firing is larger than the direct-current resistance value before firing can be restricted. To be specific, in the electronic component 10A, copper with nickel added is used as the material of the inner conductor 30. Accordingly, generation of a crack because the grain boundary is coarsened when crystal grains are grown during firing is restricted. Hence, even if a compression force is applied to the inner conductor 30 by contraction of the ferrite sheets during firing, the inner conductor 30 is prevented from being broken. As the result, the phenomenon that the direct-current resistance value after firing is larger than the direct-current resistance value before firing can be restricted.

Also, since the inner conductor 30 is prevented from being broken, a variation of the direct-current resistance value of the electronic component 10A after firing is restricted. In addition, progress of a crack when a thermal shock is applied to the electronic component 10A after firing can be restricted.

The inventor of this application executed experiments for clarifying the advantageous effects attained by the electronic component 10A. In the experiments, first, a first sample in which nickel was not added to the inner conductor 30 of the electronic component 10A, a second sample corresponding to the electronic component 10A, a third sample in which the addition amount of nickel in the inner conductor 30 of the electronic component 10A was 2 parts by weight, and a fourth sample in which the addition amount of nickel in the inner conductor 30 of the electronic component 10A was 5 parts by weight were fabricated. The number of each sample is 30. Also, each sample has a size of 1.6 mm×0.8 mm×0.8 mm, and the inner conductor 30 of each sample has a wire diameter of 0.10 mm.

First, as a first experiment, direct current was applied to the first to fourth samples, and respective resistance values were measured. As a second experiment, a thermal shock test was executed on the first and second samples. The thermal shock test holds each sample at 125° C. for 30 minutes and then holds the sample at −55° C. for 30 minutes, as a single cycle. In this test, 500 cycles in total are executed.

Figure 3:
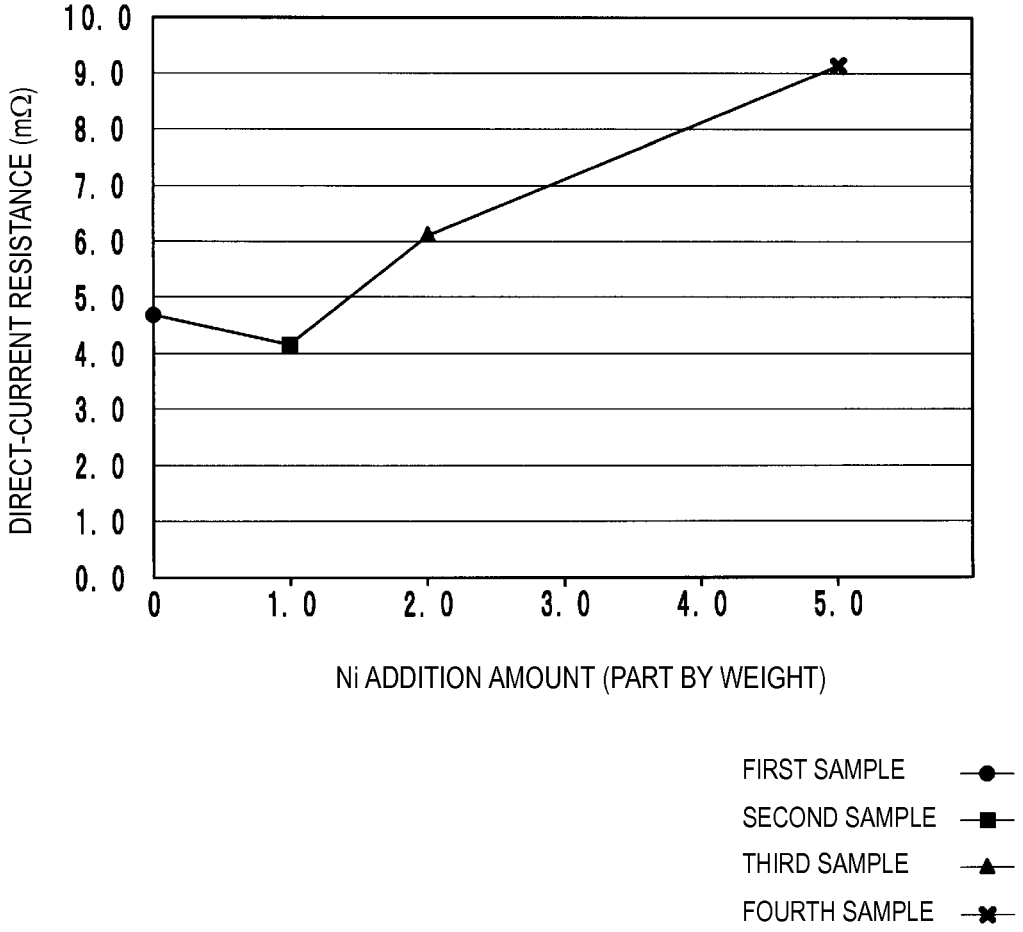
FIG. 3 is a graph showing a result obtained when a first experiment was executed on first to fourth samples.
Figure 4:
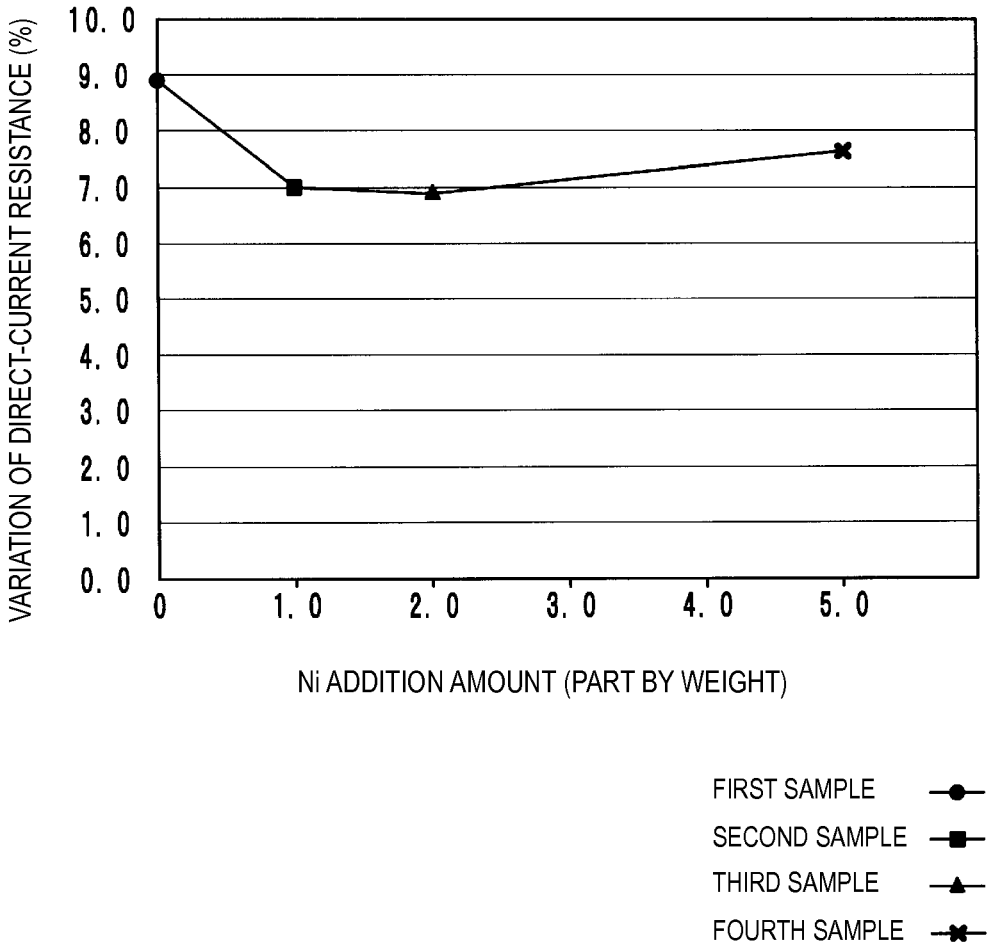
FIG. 4 is a graph showing a variation of a direct-current resistance value derived from the result obtained when the first experiment was executed on the first to fourth samples.
Figure 5:
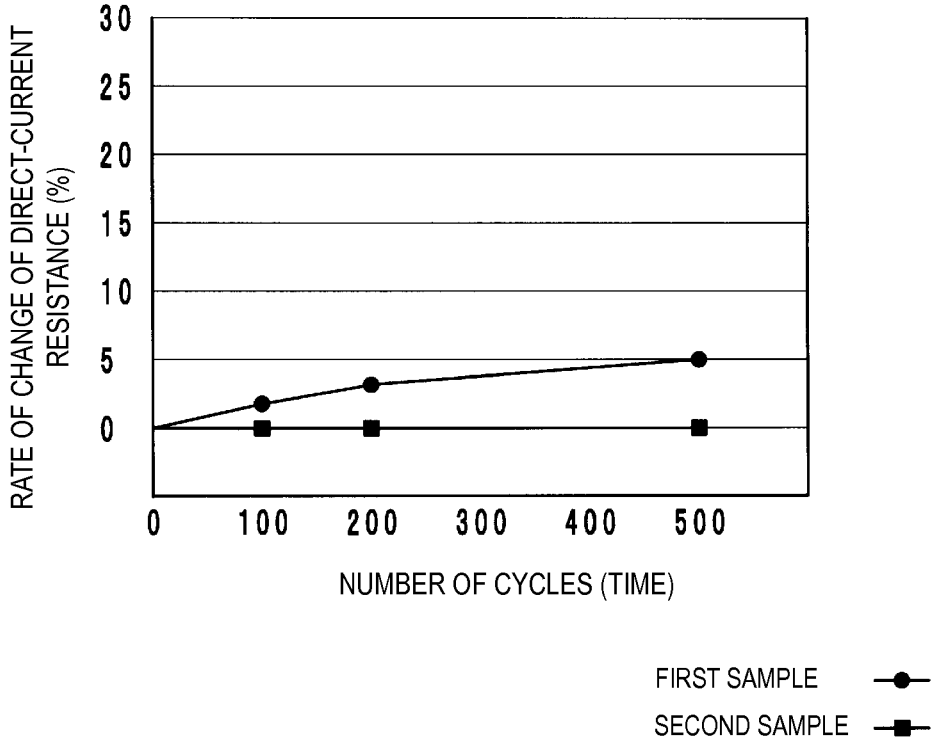
FIG. 5 is a graph showing a result obtained when a second experiment was executed on the first and second samples.

FIG. 3 is a graph showing a result obtained when the first experiment was executed on the first to fourth samples. FIG. 4 is a graph showing a variation of the direct-current resistance value derived from the result obtained when the first experiment was executed on the first to fourth samples. FIG. 5 is a graph showing a result obtained when a second experiment was executed on the first and second samples. In FIG. 3, the vertical axis indicates the direct-current resistance value (mΩ) and the horizontal axis indicates the addition value of nickel (part by weight). In FIG. 4, the vertical axis indicates the variation of the direct-current resistance value (%) and the horizontal axis indicates the addition value of nickel (part by weight). In FIG. 5, the vertical axis indicates the rate of change of the direct-current resistance value (%) and the horizontal axis indicates the number of cycles of the thermal shock test. The above-described variation of the direct-current resistance value is calculated by dividing a standard deviation by an average value.

In the first experiment, when direct current is applied, as shown in FIG. 3, it is found that the resistance value of the second sample indicates a lower value than the resistance value of the first sample. This represents that generation of a crack in the inner conductor 30 during firing is restricted and as the result an increase in direct-current resistance is restricted by adding nickel to copper. The third sample and the fourth sample indicate higher resistance values than the resistance value of the second sample because the resistivity of nickel itself is higher than the resistivity of copper and hence the resistivity of the copper alloy itself is increased by the increase in addition amount of nickel. Therefore, referring to the result of the first experiment, the direct-current resistance value of the inner conductor 30 is decreased by adding nickel. However, if the addition value of nickel exceeds 1 part by weight, the direct-current resistance value of the inner conductor 30 is increased by the resistivity of nickel itself. That is, the addition amount of nickel is preferably 1 part by weight or less.

Also, as shown in FIG. 4, it is found that the variation of the direct-current resistance value in each sample is decreased by adding nickel. This represents that generation of a crack in the inner conductor 30 during firing is restricted and as the result the variation of the direct-current resistance value is restricted by adding nickel to copper.

Further, as the result of the second experiment, as shown in FIG. 5, the rate of change of the resistance value in the first sample increases as the number of cycles increases. This is because breakage by a crack of the inner conductor 30 progressed by expansion and contraction of a sample due to a temperature difference. In contrast, the resistance value in the second sample was almost not changed. This is because a crack of the inner conductor 30 was hardly generated in the second sample and as the result breakage did not progress by a thermal shock.

SECOND EMBODIMENT

In an electronic component 10B of a second embodiment, the material of an inner conductor 30 is copper, and a surface of the inner conductor 30 is plated with nickel. Another configuration is similar to that of the first embodiment. Therefore, the description other than the inner conductor 30 in the second embodiment is similar to the description in the first embodiment.

With the electronic component 10B of the second embodiment, the phenomenon that the direct-current resistance value after firing is larger than the direct-current resistance value before firing can be restricted. To be specific, in the electronic component 10B, the surface of the inner conductor 30 is coated with nickel. Accordingly, generation of a crack in the inner conductor 30 during firing of the electronic component 10B is restricted. As the result, the phenomenon that the direct-current resistance value after firing is larger than the direct-current resistance value before firing can be restricted.

Also, since generation of a crack in the inner conductor 30 is restricted, a variation of the direct-current resistance value of the electronic component 10B after firing is restricted. In addition, progress of a crack when a thermal shock is applied to the electronic component 10B after firing can be restricted.

THIRD EMBODIMENT

In an electronic component 10C of a third embodiment, the material of an inner conductor 30 is copper, and a surface of the inner conductor 30 is plated with iron. Another configuration is similar to that of the first embodiment. Therefore, the description other than the inner conductor 30 in the third embodiment is similar to the description in the first embodiment.

With the electronic component 10C of the third embodiment, the phenomenon that the direct-current resistance value after firing is larger than the direct-current resistance value before firing can be restricted. To be specific, in the electronic component 10C, the surface of the inner conductor 30 is coated with iron. Accordingly, generation of a crack in the inner conductor 30 during firing of the electronic component 10C is restricted. As the result, the phenomenon that the direct-current resistance value after firing is larger than the direct-current resistance value before firing can be restricted.

Also, since generation of a crack in the inner conductor 30 is restricted, a variation of the direct-current resistance value of the electronic component 10C after firing is restricted. In addition, progress of a crack when a thermal shock is applied to the electronic component 10C after firing can be restricted.

The inventor of this application executed experiments for clarifying the advantageous effects attained by the electronic components 10B and 10C. To be more specific, a fifth sample in which the material of the inner conductor 30 in the electronic component 10 was copper and plating was not applied, a sixth sample corresponding to the electronic component 10B, and a seventh sample corresponding to the electronic component 10C were fabricated. The number of each sample is 30. Also, each sample has a size of 1.6 mm×0.8 mm×0.8 mm, and the inner conductor 30 of each sample has a wire diameter of 0.10 mm.

First, as a third experiment, direct current was applied to the fifth to seventh samples, and respective resistance values were measured. As a fourth experiment, a thermal shock test was executed on the fifth to seventh samples. The thermal shock test holds each sample at 125° C. for 30 minutes and then holds the sample at −55° C. for 30 minutes, as a single cycle. In this test, 500 cycles in total are executed.

Table 1 is a table showing a result obtained when the third experiment was executed on the fifth to seventh samples.

Figure 6:
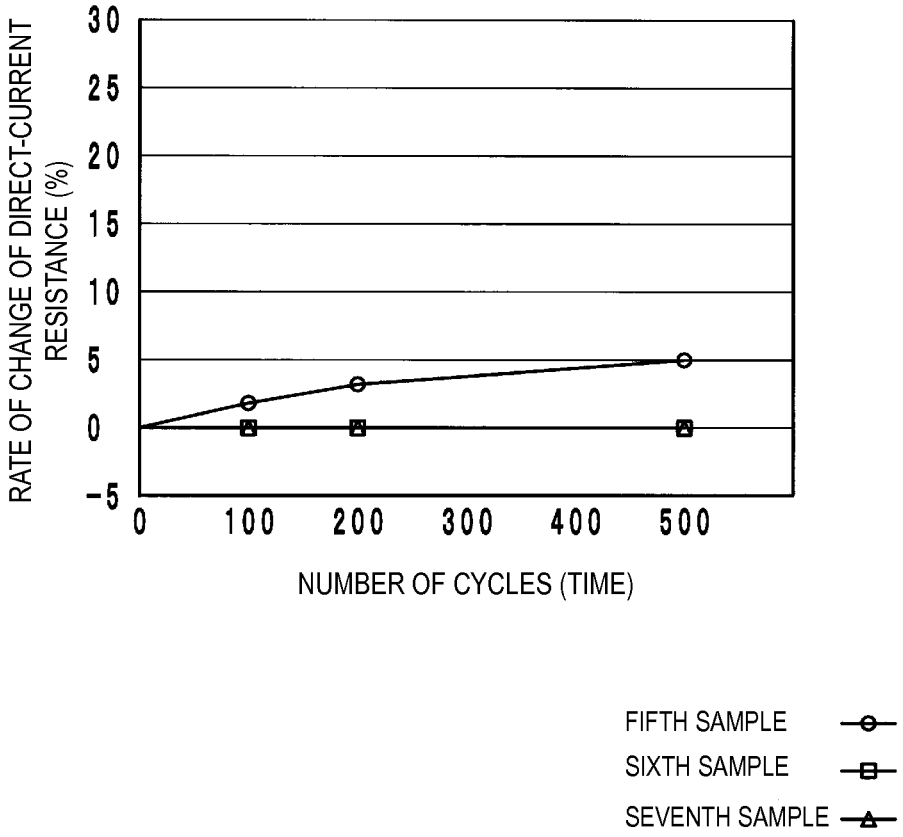
FIG. 6 is a graph showing a result obtained when a fourth experiment was executed on fifth to seventh samples.

Table 2 is a table showing a variation of the direct-current resistance value derived from the result obtained when the third experiment was executed on the fifth to seventh samples. FIG. 6 is a graph showing a result obtained when the fourth experiment was executed on the fifth to seventh samples. In FIG. 6, the vertical axis indicates the rate of change of the direct-current resistance value (%) and the horizontal axis indicates the number of cycles of the thermal shock test.

TABLE 1

| | Direct-current resistance (mΩ) |
|---|---|
| Fifth sample | 4.7 |
| Sixth sample | 4.2 |
| Seventh sample | 3.6 |

TABLE 2

| | Variation of direct-current resistance (%) |
|---|---|
| Fifth sample | 8.9 |
| Sixth sample | 3.6 |
| Seventh sample | 4.9 |

In the third experiment, when direct current is applied, as shown in Table 1, it is found that the resistance value of the seventh sample indicates the lowest value. This represents that generation of a crack in the inner conductor 30 during firing is restricted and as the result an increase in direct-current resistance is restricted by coating the inner conductor 30 with iron. The sixth sample indicates a higher resistance value than the resistance value of the seventh sample because since the resistivity of nickel itself is higher than the resistivity of copper, the resistance at the surface of the inner conductor 30 increases.

Also, as shown in Table 2, the variations of the direct-current resistance values of the sixth and seventh samples are smaller than the variation of the direct-current resistance value of the fifth sample. This is because since the surface of the inner conductor 30 is coated with nickel or iron, a crack in the inner conductor 30 during firing is restricted, and as the result, the variation of the direct-current resistance value is restricted.

Further, as the result of the fourth experiment, as shown in FIG. 6, the resistance values of the sixth and seventh samples were hardly changed. This is because a crack of the inner conductor 30 is hardly generated in the sixth and seventh samples and as the result breakage due to a crack did not progress by a thermal shock.

FOURTH EMBODIMENT

Figure 7:
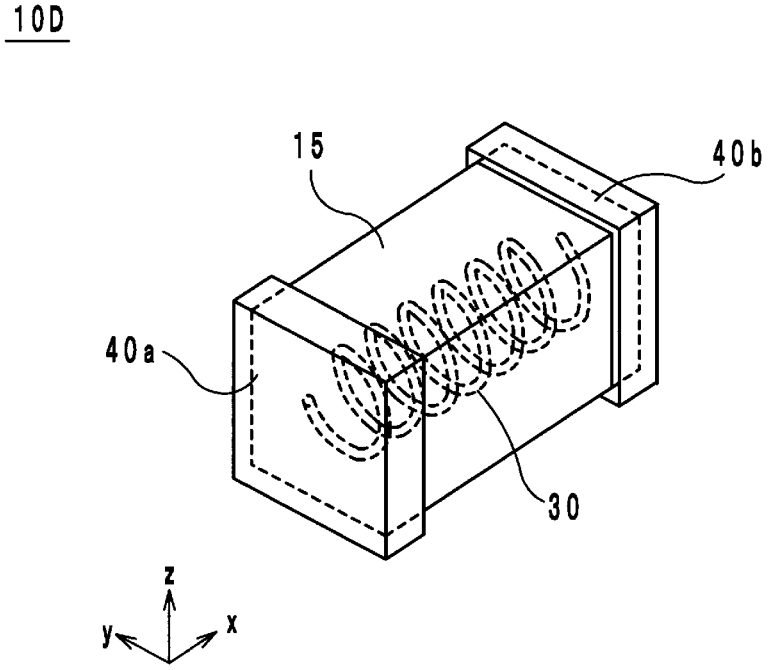
FIG. 7 is an external perspective view of an electronic component according to a fourth embodiment.
Figure 8:
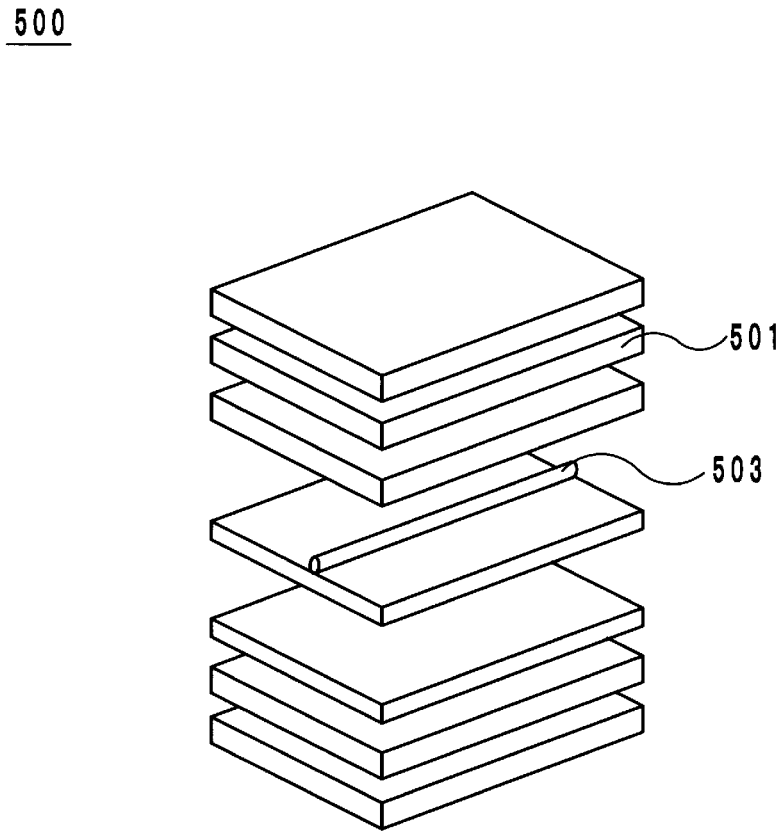
FIG. 8 PRIOR ART
FIG. 8 is an exploded perspective view of an inductor element of the same type as an inductor element described in Japanese Unexamined Patent Application Publication No. 7-22266.
Figure 9:
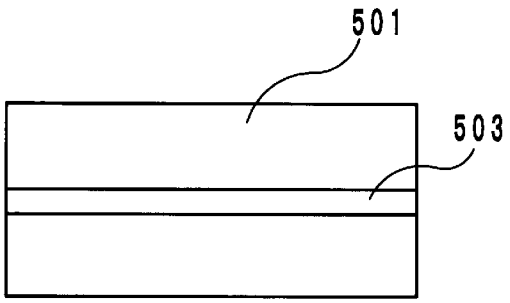
FIG. 9 PRIOR ART
FIG. 9 is an illustration in plan view from a stacking direction of ferrite sheets in which a metal conductor is arranged, in the inductor element of the same type as the inductor element described in Japanese Unexamined Patent Application Publication No. 7-22266.
Figure 10:
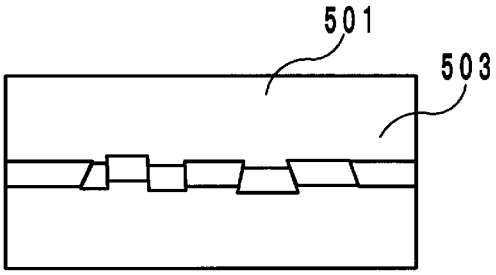
FIG. 10 PRIOR ART
FIG. 10 is an illustration in plan view from the stacking direction of the ferrite sheets in which the metal conductor is arranged, in the inductor element of the same type as the inductor element described in Japanese Unexamined Patent Application Publication No. 7-22266 after firing.

An electronic component 10D of a fourth embodiment differs from the electronic component 10 of the first embodiment in that the shape of an inner conductor 30 is a spiral shape being advanced in the x-axis direction, and the inner conductor 30 is covered with a rectangular-parallelepiped-like ceramic sintered compact 15 instead of the multilayer body 12 as shown in FIG. 7. Another configuration is similar to that of the first embodiment. Therefore, the other description in the fourth embodiment is similar to the description in the first embodiment.

With the electronic component 10D configured as described above, since the shape of the inner conductor 30 is the spiral shape, as compared with the electronic component 10, a higher inductance value can be obtained.

OTHER EMBODIMENTS

The electronic component according to the present disclosure is not limited to the above-described embodiments, and may be modified within the scope of the disclosure.

In particular, the material, shape, and size of the insulating layer may be properly selected in accordance with the purpose. Also, iron may be used as an additive to the inner conductor 30.

INDUSTRIAL APPLICABILITY

As described above, the present disclosure is useful for an electronic component in which a conductor is embedded in a sintered compact. In particular, the present disclosure is advantageous because a phenomenon that the direct-current resistance value after firing is larger than the direct-current resistance value before firing can be restricted.

The invention claimed is:

1. An electronic component, comprising:
a ceramic sintered compact; and
an inner conductor formed of a wire rod containing copper as a major constituent and having nickel added thereto, the inner conductor configuring a circuit element, wherein
when the copper in the inner conductor is 100 parts by weight, an addition amount of the nickel is 1 part by weight or less.

2. An electronic component, comprising:
a ceramic sintered compact; and
an inner conductor configuring a circuit element and formed of a wire rod containing copper as a major constituent,
wherein a surface of the wire rod is coated with nickel, wherein
when the copper in the inner conductor is 100 parts by weight, an addition amount of the nickel is 1 part by weight or less.

3. The electronic component according to claim 2,
wherein the surface of the wire rod is coated with the nickel by plating.

4. The electronic component according to claim 1,
wherein the ceramic is ferrite containing iron, zinc, copper, and manganese.

5. The electronic component according to claim 1,
wherein the ceramic is ferrite containing iron, nickel, copper, and manganese.

6. The electronic component according to claim 1,
wherein the ceramic is ferrite containing iron, nickel, zinc, copper, and manganese.

* * * * *